United States Patent [19]

Tsuneda

[11] 4,040,970

[45] Aug. 9, 1977

[54] LIQUID DEVELOPER FOR DEVELOPING AN ELECTROSTATIC LATENT IMAGE

[75] Inventor: Terukuni Tsuneda, Yokohama, Japan

[73] Assignee: Canon Kabushiki Kaisha, Tokyo, Japan

[21] Appl. No.: 575,720

[22] Filed: May 8, 1975

[30] Foreign Application Priority Data

May 17, 1974 Japan ..... 49-55774

[51] Int. Cl.[2] ..... G03G 9/12

[52] U.S. Cl. ..... 252/62.1 L; 96/1 LY; 252/62.1 R; 260/31.8 R; 260/31.8 M; 260/31.8 T; 260/47 UA; 526/263; 526/317; 526/319; 526/310; 526/321; 526/332

[58] Field of Search ..... 260/31.8 R, 31.8 M, 260/31.8 T, 47 UA; 252/62.1 R, 62.1 L; 526/263, 319, 317, 321, 332, 310; 96/1 LY

[56] References Cited

U.S. PATENT DOCUMENTS

| | | | |
|---|---|---|---|
| 3,554,946 | 1/1971 | Okuno et al. | 252/62.1 |
| 3,585,140 | 6/1971 | Machida et al. | 252/62.1 |
| 3,623,986 | 11/1971 | Machida et al. | 252/62.1 |
| 3,705,137 | 12/1972 | Kuwahara et al. | 260/31.8 M |
| 3,729,418 | 4/1973 | Machida et al. | 252/62.1 |
| 3,849,165 | 11/1974 | Stahly et al. | 96/1 LY |
| 3,870,644 | 3/1975 | Machida et al. | 252/62.1 |
| 3,874,896 | 4/1975 | Machida et al. | 252/62.1 |

*Primary Examiner*—Mayer Weinblatt
*Assistant Examiner*—John D. Smith
*Attorney, Agent, or Firm*—Fitzpatrick, Cella, Harper & Scinto

[57] ABSTRACT

A liquid developer for developing an electrostatic latent image comprising an electrically insulating carrier liquid and a toner dispersed therein comprises a copolymer having a property of rendering the toner negatively chargeable.

8 Claims, No Drawings

LIQUID DEVELOPER FOR DEVELOPING AN ELECTROSTATIC LATENT IMAGE

This application is related to former co-pending application Ser. No. 387,473, filed Aug. 10, 1973, now U.S. Pat. No. 3,969,238, issued July 13, 1976.

BACKGROUND OF THE INVENTION

1. Field of the Invention

This invention relates to a liquid developer for developing an electrostatic latent image in the fields of electrophotography, electrostatic printing and the like.

2. Description of the Prior Art

Heretofore, a liquid developer for developing an electrostatic latent image in electrophotography and the like has been that generally prepared in such a manner that a pigment, a dye and the like are kneaded along with a resin, a dispersing agent, a chargeability controlling agent, a solvent and the like to form a paste-like kneaded material and the kneaded material is dispersed in a highly insulating carrier liquid. The dispersing agent and chargeability controlling agent are important components which are used for the purpose of improving chargeability, dispersion stability, preservation stability and the like of the toner in the liquid developer. As such dispersing agent and chargeability controlling agent, linseed oil, soybean oil, rosin, asphalt and the like have been used so far. However, these natural products are not constant in their compositions, and therefore it has been very difficult to prepare a liquid developer which has always a constant property. Further, the liquid developer has had such a drawback that the dispersibility and the charge polarity of the toner particles become poor and unclear during use and preservation thereof for a long period of time.

As a method for controlling the polarity of the toner in the liquid developer, in addition to a method of coating the surface of the pigment particles with various natural products as mentioned above, a method in which a surface active agent is dissolved in the carrier liquid of the liquid developer to cause it to adsorb on the toner to control the charged state of the toner has been known. As the surface active agent used for the purpose, there may be mentioned numerous materials, for example, a metal soap such as cobalt naphthenate, nickel naphthenate, manganese naphthenate and the like, a metal alkylbenzenesulfonate, and a phosphatide such as lecithin, cephalin and the like, but their manners of use and effects are not always constant. Further, these surface active agent are generally of a lower electric resistance so that they inevitably lower the electric resistance of the carrier liquid when they are dissolved in such carrier liquid. On account of this, the surface active agent should be dissolved in the carrier liquid to such an extent that it does not destroy an electrostatic latent image formed on a photosensitive member so that the amount of the surface active agent to be added is subjected strict restriction. Thus, such method using the surface active agent is considered to be defective in that the surface active agent can not be added to the carrier liquid in an amount sufficient to control the chargeability of the toner in the liquid developer.

The materials for controlling the polarity of the toner so as to be negative by dissolving them in the carrier liquid are few, and only lecithin, an alkylbenzenesulfonate, a polyamide resin and the like are known. When these materials are used for a liquid developer as a chargeability controlling agent, they can not impart a sufficiently high interfacial potential to the toner and they change in their qualities owing to the oxidation, for example, due to contact with air while allowed to stand, the oxidizing function of the other components in the toner composition and the oxidizing function of the ozone and the like generating upon corona charging in operation of a copying machine. As the result, the chargeability controlling property of such materials in deteriorated, and therefore the image density and sharpness of the resulting image are liable to lower. In view of the foregoing, the liquid developer containing such materials has had the drawback that is can not be used for a long period of time.

SUMMARY OF THE INVENTION

It is a primary object of this invention to provide a novel liquid developer for developing an electrostatic latent image which is of negative chargeability and free from the abovementioned drawbacks.

It is another object of this invention to provide a liquid developer for developing an electrostatic latent image in which a negatively chargeable chargeability controlling agent capable of being well soluble in the carrier liquid and imparting a sufficient chargeability to the toner particles without lowering the electric resistance of the carrier liquid is dissolved in the carrier liquid.

It is a further object of this invention to provide a liquid developer for developing an electrostatic latent image which is excellent in the oxidation resistance property and capable of giving a sharp image free from fog even when it is used for a long period of time.

The present inventor has carried out the experiment with respect to the effect of various polymers and copolymers on the toner, for example the chargeability controlling property, oxidation resistance and preservation stability by dissolving them in the carrier liquid. As the result, it has been found that the copolymer as mentioned below is capable of rendering the toner remarkably negatively chargeable and exhibits excellent effect on the oxidation resistance and preservation stability of the toner.

According to this invention, there is provided a liquid developer for developing an electrostatic latent image comprising an electrically insulating carrier liquid and a toner dispersed therein which comprises a copolymer composed of at least one member selected from the monomers of the formula (1), at least one member selected from the monomers of the formula (2) and at least one member selected from the monomers of the formula (3), Formula (1):

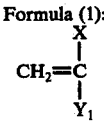

wherein X is selected from the class of H and $CH_3$ and $Y_1$ is selected from the class of $-C_nH_{2n+1}$, $-OC_nH_{2n+1}$ and $-COOC_nH_{2n+1}$, wherein $n$ is a positive integer, Formula (2):

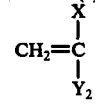

wherein X is selected from the class of H and $CH_3$, and $Y_2$ is selected from the class of the following:

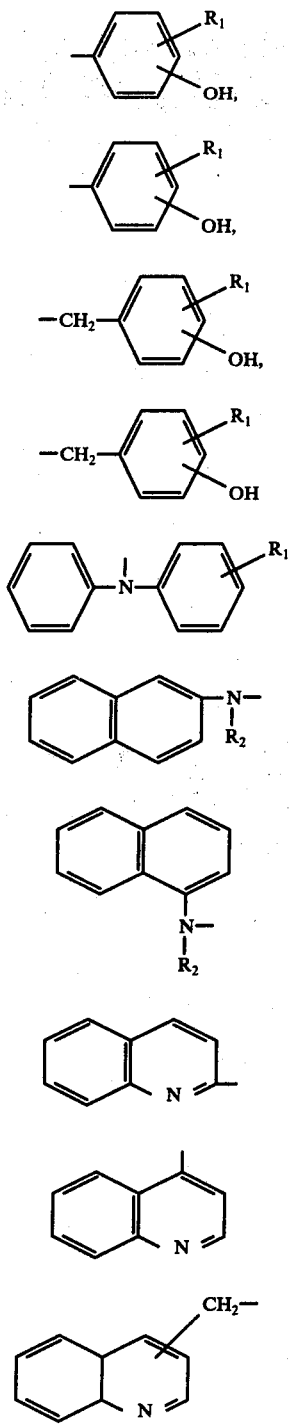

Wherein $R_1$ is selected from the class of H and $-C_nH_{2n+1}$ ($1 \leqq n \leqq 4$), and $R_2$ is selected from the class of H, $-C_mH_{2m+1}$ ($1 \leqq m \leqq 4$),

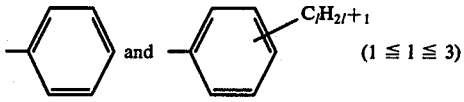

Formula (3):

-continued

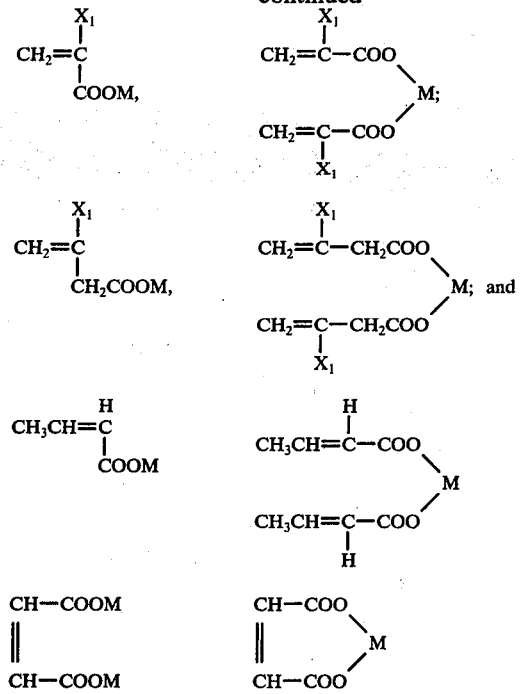

wherein $X_1$ is selected from H, $CH_3$ and COOM and M is selected from the class of an alkali metal and an alkaline earth metal.

DESCRIPTION OF THE PREFERRED EMBODIMENTS

The copolymer prepared from the monomers of the foregoing formulae (1), (2) and (3) is well soluble in the carrier liquid, excellent in the chemical stability such as oxidation resistance and the like as well as in the preservation stability and has a property of controlling the toner so as to be negatively chargeable. In the copolymer, the monomer of the formula (1) is considered to increase the solubility of the copolymer in the carrier liquid and contribute to the dispersiblity of the toner when it adsorbs on the toner. In particular, when the monomer of the formula (1) containing an alkyl group having 8–20 carbon atoms is used, the copolymer exhibits a preferable solubility in the carrier liquid. The monomer of the formula (2) is considered to increase the oxidation resistance and chemical stability of the copolymer. Further, the monomer of the formula (3) has been found to control the toner so as to be negatively chargeable and increase the effect of the oxidation resistance and preservation stability.

The ratio of the monomers of the formulae (1), (2) and (3) which constitute the copolymer can be changed in various range depending upon the monomers to be selected. However, it is necessary for the copolymer to contain the monomer of the formula (1) in a mole ratio of such an extent that the solubility of the copolymer in the carrier liquid does not decrease. The monomer of the formula (2) has an effect even in a small amount and may be used in a mole ratio of such a range that the solubility of the copolymer in the carrier liquid is not lost. Further, the monomer of the formula (3) has an effect of rendering the toner negatively chargeable even in a small amount and may be used in a mole ratio of such a range that is does not decrease the solubility of the copolymer in the carrier liquid.

The monomer of the formula (3) may not be in a form of a metal salt. In other words, it may be acrylic acid, methacrylic acid, itaconic acid, maleic acid or the like. In case that each of these acids is used along with the monomers of the formulae (1) and (2) to prepare a copolymer, the copolymer is first prepared, and subsequently it may be converted into a metal salt. The copolymer thus obtained has the same effect of controlling the chargeability of the toner as that of the copolymer which is prepared from the monomer of the formula (3) of a metal salt and the monomers of the formulae (1) and (2).

The carrier liquid used for the liquid developer of this invention may be that having been so far used for a conventional liquid developer for electrophotography, and it is preferably an organic solvent having a volume resistivity of $10^9$ ohm-cm or more and a dielectric constant of 3 or less. In such organic solvent are included paraffinic hydrocarbons, isoparaffinic hydrocarbons, alicyclic hydrocarbons, halogenated hydrocarbons and the like, more particularly there may be mentioned n-heptane, cyclohexane, dipentene, lamp oil kerosene, mineral spirit, tetralin, perchloroethylene, trichlorotrifluoroethane and the like.

As the toner to be dispersed in the carrier liquid, a pigment or a finely pulverized kneaded mixture of a binder resin and a pigment is preferably used.

As the pigment to be used, there may be mentioned the following:

| | |
|---|---|
| Mogul A | |
| Elftex 5 | |
| Elf Vulcan XC | (trade names for products of Godfrey L. Cabot Inc., U.S.A.) |
| Statex | (trade name for a product of Colombia Carbon Co., U.S.A.) |
| Carbon Black XC-550 | (trade name for a product of Asahi Carbon K.K., Japan) |
| Carbon Black No. 44 | |
| Carbon Black No. 100 | (trade names for products of Mitsubishi Kasei K.K., Japan) |
| Benzidine Yellow GNN | |
| Benzidine Orange | |
| Scarlet KR | |
| Fast Red | |
| Brilliant Carmine 6B | |
| Sky Blue | |
| Cyanine Blue FG | |
| Phthalocyanine Green L.L. | (trade names for product of Sanyo Shikiso K.K., Japan) |
| Victoria Blue | |
| Spilon Black | |
| Spilon Orange | |
| Spilon Red | (trade names for products of Hodogaya Kagaku K.K., Japan) |
| Oil Blue | |
| Vari Fast Blue | |
| Spirit Black | |
| Alkali Blue | (trade names for products of Orient Kasei K.K., Japan) |
| Aniline Black | (a product of I.C.I. Co.) |
| Cyanine Blue NSG | |
| Fast Rose 836 | |
| Benzidine Yellow 471 | (trade names for product of Dainichi Seika K.K., Japan) |
| Fanal Pink | (C.I. No. 45160) |
| Heliogen Blue | (C.I. No. 74100) (trade names for products of Badische Anilin & Soda Fabrik A.G.) |
| Victoria Blue LAKE | (C.I. No. 42595 Lake) |
| Lionogen Magenta R | (C.I. No. 46500) (trade names for products of Toyo Ink. K.K.) |
| Cromophtal Blue 4G | (C.I. No. 74160) (trade name for a product of Ciba Ltd.) |
| Seikafast Carmine 6B | (C.I. No. 15850) |
| Seikalight Rose R-40 | (C.I. No. 45160) |
| Seikafast Blue A612 | (C.I. No. 74200) |
| Seikafast Yellow H7055 | (C.I. No. 21090) |
| Seikafast Yellow | (C.I. No. 21105) |

-continued

| | |
|---|---|
| GT-2400 | (trade names for products of Dainichi Seika K.K.) |

| | |
|---|---|
| Benzidine Yellow GNN | C.I. 21090 |
| Benzidine Orange | C.I. 21110 |
| Scarlet KR | C.I. 15865 |
| Fast Red | C.I. 23050 |
| Brilliant Carmine 6B | C.I. 15850 |
| Sky Blue | C.I. 77368 |
| Cyanine Blue FG | C.I. 74160 |
| Phthalocyanine Green LL | C.I. 74260 |
| Victoria Blue | C.I. 42595 Lake |
| Spilon Black | C.I. Solvent Black 22 |
| Spilon Orange | C.I. Solvent Orange 37 |
| Spilon Red | C.I. Solvent Red 83 |
| Oil Blue | C.I. 74350 |
| Vari Fast Blue | C.I, 42595 |
| Spirit Black | C.I. 50415 |
| Alkali Blue | C.I. 42750 |
| Aniline Black | C.I. 50440 |
| Cyanine Blue NSG | C.I. 74250 |
| Fast Rose 836 | C.I. 45170 |
| Benzidine Yellow 471 | C.I. 21095 |

The pigments are used for the purpose of coloring the toner particles and it is clear that all the pigments heretofore used for a toner are applicable to this invention.

As the binder resin to be mixed with the abovementioned coloring powders which is used mainly for the purpose of imparting the fixability, dispersibility and transferability to the toner, the resin heretofore used for a toner are usable. More particularly, the use of the following resins is preferable.

For example, polyvinyl chloride, polyvinylidene chloride, a vinyl chloride-vinylidene chloride copolymer, a chlorinated polypropylene, a vinyl chloride-vinyl acetate copolymer, a vinyl chloride-vinyl acetate-maleic anhydride copolymer, rubber hydrochloride, cyclized rubber, wax rubber, ethyl cellulose, nitro cellulose, polyacrylic acid ester, linseed oil modified alkyd resin, polyvinyl acetate, polyamide resin, cumarone resin, dammar resin, copophonium modified phenolic resin, ketone resin, maleic acid resin, polystyrene, low molecular polyethylene, copophonium, copal, stebelite ester, phenol modified pentaerythritol ester and the like are usable.

The copolymer to be used in this invention for the purpose of rendering the toner negatively chargeable may be synthesized in the following manner.

At least one member selected from the monomers of the foregoing formula (1), at least one member selected from the monomers of the formula (2) and at least one member selected from the monomers of the formula (3) are subjected to solution polymerization or bulk polymerization in the presence of a polymerization initiator such as azoisobutyronitrile, benzoyl peroxide and the like in a nitrogen gas atmosphere.

Among the monomers of the formula (1) are included vinyl laurate, vinyl oleate, vinyl stearate, dodecyl acrylate, octyl acrylate, stearyl acrylate, tridecyl acrylate, hexadecyl acrylate, dodecyl methacrylate, heptadecyl methacrylate, stearyl methacrylate, lauryl vinyl ether, n-octyl vinyl ether, tridecyl vinyl ether and the like.

Among the monomers of the formula (2) are included o-allylphenol, m-allylphenol, p-allylphenol, 4-allyl-2-methoxyphenol, 4-vinyl-2-methoxyphenol, o-vinylphenol, m-vinylphenol, p-vinylphenol, 2,5-dihydroxystyrene, 4-allyl-2,6-di-tert-butylphenol, 4-vinyl-2,6-di-tert-butylphenol, 4-allyl-2,6-dimethoxyphenol, 4-vinyl-2,6-dimethoxyphenol, 2-vinyl quinoline, 4-vinyl quinoline, 2-allyl quinoline, 4-allyl quinoline, N-vinyldiphenylamine, N-vinylmethyl-β-naphthylamine, N-vinylphenyl-α-naphthylamine, N-vinyl-p-tolyl-α-naphthylamine, N-vinyl-o-tolyl-α-naphthylamine, N-vinyl-m-tolyl-α-naphthylamine and the like Among the monomers of the formula (3) are included sodium acrylate, potassium acrylate, lithium acrylate, sodium methacrylate, potassium methacrylate, lithium methacrylate, sodium itaconate, potassium itaconate, lithium itaconate, sodium crotonate, potassium crotonate, lithium crotonate, sodium maleate, potassium maleate, lithium maleate, calcium acrylate, barium acrylate, calcium methacrylate, barium methacrylate, calcium itaconate, barium itaconate, calcium crotonate, barium crotonate, calcium maleate, barium maleate and the like.

The copolymer used in this invention has an effect even when a small amount thereof is dissolved in the carrier liquid. For example when about 0.015g or more of the copolymer is dissolved in 1 liter of the carrier liquid, its effect can be recognized. The copolymer is so weak in the property of lowering the electric resistance of the carrier liquid that a considerable large amount thereof may be dissolved in the carrier liquid, and the amount may be selected within such a range that the lowering of the electric resistance of the carrier liquid is allowable. The deterioration of the property of the resulting liquid developer due to the variation of the amount of the copolymer is not recognized. However, it is desired to use the copolymer in an amount ranging from 0.015g to 10g, preferably 0.015g to 1.0g per 1 liter of the carrier liquid, which is advantageous from an economical point of view, and further no electric resistance of the carrier liquid lowers.

The invention will be understood more readily by reference to the following examples. However, these examples are intended to illustrate the invention and are not to be construed to limit the scope of the invention.

EXAMPLE 1

In a 500ml four-necked flask were placed 400ml of 10% water-containing dioxane (10% water and 90% dioxane) 0.2 mole of stearyl methacrylate, 0.1 mole of potassium methacrylate, 0.1 mole of 4-allyl-2-methoxyphenol and 0.01 mole of α,α'-azobisisobutyronitrile and the air in the flask was sufficiently replaced by nitrogen gas. The mixture was then stirred at 85° C for 8 hours to allow it to cool. The reaction solution was concentrated under a reduced pressure and 20% water-containing methanol was added thereto to cause the oily reaction product to separate out and it was dried. The product was dissolved in benzene to cause it to separate out by means of methanol so that it was purified. The purification was repeated twice to obtain a white material of powder. The material was analyzed by means of infrared spectroscopic analysis, nuclear magnetic resonance (NMR), elementary analysis and emission spectroanalysis to confirm that it was a copolymer of stearyl methacrylate, potassium methacrylate and 4-allyl-2-methoxyphenol.

With a roll mill, 39g of carbon black, 200g of XPL2005 (trade name for a polyester resin of Kao Atlas Co.) and 40g of Piccolyte S-115 (trade name for a polyterpene resin of Esso Standard Oil Co.) were kneaded. 300g of the resulting kneaded material was dispersed in 800g of Isopar H (trade name for an isoparaffinic hydrocarbon of Esso Standard Oil Co.) along with 40g of Piccolyte S-115 and 180g of a 20% solution of Solprene (trade name for a styrene-butadiene copolymer of Asahi Kasei K.K.) in toluene with an attritor (dispersing device) for 3 hours. 30ml of the resulting dispersed liquid and 0.05g of the above-mentioned copolymer were dispersed in 800g of Isopar H to prepare a liquid developer -A according to this invention. Further, as liquid developers for comparison, a liquid developer -B containing no copolymer as mentioned above was prepared in the same manner, and a liquid developer -C was prepared in the same manner except that 0.05g of potassium dodecylbenzene sulfonate was used in place of the above-mentioned copolymer.

In the meantime, a dispersion solution of 100g of a finely crystallized cadmium sulfide, 10g of a 50% solution of a vinyl chloride-vinyl acetate copolymer in toluene and 80g of toluene was coated onto an aluminum foil of 0.05mm in thickness in order that the coating might be 40 microns in thickness after drying. A polyester film of 38 microns in thickness was sticked onto the coating with an expoly resin adhesive of cold setting type to prepare a three-layered photosensitive member. The prepared photosensitive member was subjected to corona charging at +7KV and then, AC corona charging at 7KV was carried out simultaneously with an imagewise exposure and further the whole surface of the photosensitive member was uniformly exposed to form an electrostatic latent image. The latent image was developed with the foregoing liquid developer -A to obtain a good positive image. A transfer paper was brought into contact with the surface having the image to carry out charging at +6KV from the back side. The transfer paper was peeled off so that the image on the photosensitive member was substantially perfectly transferred to the transfer paper. It was found that the transferred image was sharp with a high density and it was perfectly fixed by means of thermal fixation.

The comparison test among the liquid developers A, B and C was carried out with respect to the image density and fog density of the image which were developed with those liquid developers in the same manner. The used liquid developers were those immediately after prepared and those allowed to stand for 1 month. The result of the test are shown in the following table.

| Liquid developer | Liquid developer at the preparation time | | Liquid developer allowed to stand for one month | |
|---|---|---|---|---|
| | Image density | Fog density | Image density | Fog density |
| A | 1.31 | 0.02 | 1.30 | 0.02 |
| B | 0.52 | 0.05 | 0.40 | 0.05 |
| C | 1.0 | 0.03 | 0.50 | 0.04 |

From the result, it was found that the image developed with the liquid developer -A of this invention was practically sufficiently high in the image density, substantially free from fog and excellent in the preservation stability.

EXAMPLE 2

A copolymer was prepared in the same procedure as in Example 1 except that methacrylic acid was used in place of potassium methacrylate. The prepared copolymer was dissolved in 500ml of a mixed solution of tetrahydrofuran and carbon tetrachloride (1:1), to which 80ml of a mixed solution of water and alcohol (1:1) containing 0.2 mole of potassium hydroxide was further added. The mixture was stirred at a room temperature for 2 hours. The product was caused to separate out by means of 20% water-containing methanol, washed with alcohol and dried to obtain the same copolymer as that obtained in Example 1. The product was used for the preparation of a liquid developer and the same comparison test as in Example 1 was carried out to obtain exactly the same result.

EXAMPLE 3

The procedure for preparing the copolymer in Example 1 was repeated except that potassium itaconate and o-allylphenol were used in place of potassium methacrylate and 4-allyl-2-methoxyphenol, respectively to obtain a copolymer of stearyl methacrylate, potassium itaconate and O-allyl phenol.

| | |
|---|---|
| Copper phthalocyanine blue | 50g |
| Cumarone resin | 300g (50% xylene solution) |
| Cyclized rubber | 200g (25% xylene solution) |
| Low molecular polyethylene | 50g (50% xylene solution) |
| Isopar H | 800g |

The mixture of the above-mentioned components was kneaded with an attritor for 3 hours to obtain a dispersed material. 25ml of the dispersion and 0.05g of the above-mentioned copolymer were dispersed in 800g Isopar H to prepare a liquid developer -D according to this invention. As liquid developers for comparison, a liquid developer -E was prepared in the above mentioned manner except that no copolymer was dispersed, and further a liquid developer -F was prepared in the same manner except that Aerosol OT (diisooctyl sodium sulfosuccinate) was used in place of the above-mentioned copolymer.

The liquid developers were used to carry out the same comparison test as in Example 1 so that the following result was obtained.

| Liquid developer | Liquid developer at the preparation time | | Liquid developer allowed to stand for one month | |
|---|---|---|---|---|
| | Image density | Fog density | Image density | Fog density |
| D | 1.29 | 0.02 | 1.30 | 0.02 |
| E | 0.51 | 0.05 | 0.40 | 0.05 |
| F | 1.15 | 0.03 | 1.0 | 0.04 |

EXAMPLES 4–12

In the procedure of Example 1, the monomers listed in the following table were used in place of potassium methacrylate to prepare copolymers in the same manner. The following results were obtained.

| Example No. | Kind of monomer | Liquid developer at the preparation time | | Liquid developer allowed to stand for one month | |
|---|---|---|---|---|---|
| | | Image density | Fog density | Image density | Fog density |
| 4 | Potassium acrylate | 1.30 | 0.02 | 1.30 | 0.02 |
| 5 | Potassium itaconate | 1.32 | 0.02 | 1.31 | 0.02 |
| 6 | Potassium crotonate | 1.28 | 0.02 | 1.29 | 0.02 |
| 7 | Potassium maleate | 1.29 | 0.02 | 1.30 | 0.02 |

-continued

| Example No. | Kind of monomer | Liquid developer at the preparation time | | Liquid developer allowed to stand for one month | |
|---|---|---|---|---|---|
| | | Image density | Fog density | Image density | Fog density |
| 8 | Lithium methacrylate | 1.31 | 0.02 | 1.30 | 0.02 |
| 9 | Sodium methacrylate | 1.31 | 0.02 | 1.31 | 0.02 |
| 10 | Lithium itaconate | 1.30 | 0.02 | 1.31 | 0.02 |
| 11 | Calcium methacrylate | 1.29 | 0.02 | 1.29 | 0.02 |
| 12 | Barium methacrylate | 1.29 | 0.02 | 1.30 | 0.02 |

EXAMPLE 13

In the procedure of Example 1, vinyl stearate and 4-allyl-2,6-di-tert-butyl phenol were used in place of stearyl methacrylate and 4-allyl-2-methoxy phenol, respectively to prepare a copolymer in the same manner. The same comparison test as in Example 1 was carried out to obtain substantially the same result.

EXAMPLE 14

In the procedure of Example 1, dodecyl methacrylate and 4-vinyl-2,6-dimethoxy phenol were used in place of stearyl methacrylate and 4-allyl-2-methoxyphenol, respectively, to prepare a copolymer in the same manner. The same comparison test as in Example 1 was carried out to obtain substantially the same result.

EXAMPLE 15

In the procedure of Example 1, tridecyl methacrylate and N-vinyl diphenylamine were used in place of stearyl methacrylate and 4-allyl-2-methoxyphenol, respectively, to prepare a copolymer in the same manner. The same comparison test as in Example 1 was carried out to obtain substantially the same result.

EXAMPLE 16

In the procedure of Example 1, lauryl vinyl ether and N-vinylmethyl -$\beta$-naphthylamine were used in place of stearyl methacrylate and 4-allyl-2-methoxyphenol, respectively to prepare a copolymer in the same manner. The same comparison test as in Example 1 was carried out to obtain substantially the same result.

EXAMPLE 17

In the procedure of Example 1, n-octyl vinyl ether and N-vinyl-p-tolyl-$\alpha$-naphthylamine were used in place of stearyl methacrylate and 4-allyl-2-methoxyphenol, respectively, to prepare a copolymer in the same manner. The same comparison test as in Example 1 was carried out to obtain substantially the same result.

EXAMPLE 18

In the procedure of Example 1, 4-vinyl quinoline was used in place of 4-allyl-2-methoxyphenol to prepare a copolymer in the same manner. The same comparison test as in Example 1 was carried out to obtain substantially the same result.

I claim:

1. A liquid developer for developing an electrostatic latent image comprising an electrically insulating carrier liquid, a toner dispersed therein, and a copolymer for rendering the toner negatively charged composed of at least one member selected from the monomers of the formula (1) at least one member selected from the monomers of the formula (2) and at least one member selected from the monomers of the formula (3), Formula (1):

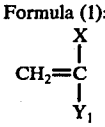

wherein X is selected from the class of H and $CH_3$ and $Y_1$ is selected from the class of $-C_nH_{2n+1}$, $-OC_nH_{2n+1}$ and $-COOC_nH_{2n+1}$, wherein $n$ is an integer from 8 to 20;

Formula (2):

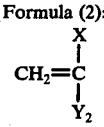

wherein X is selected from the class of H and $CH_3$ and $Y_2$ is selected from the class of the following:

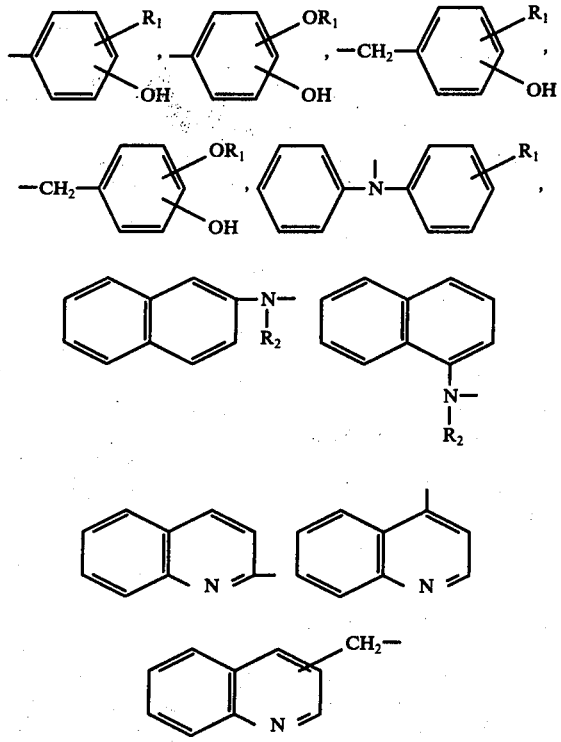

wherein $R_1$ is selected from the class of H and $-C_nH_{2n+1}$ ($1 \leqq n \leqq 4$), and $R_2$ is selected from the class of H, $-C_mH_{2m+1}$

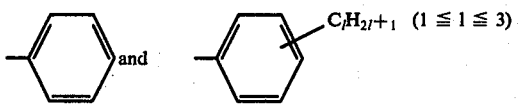

Formula (3):

-continued

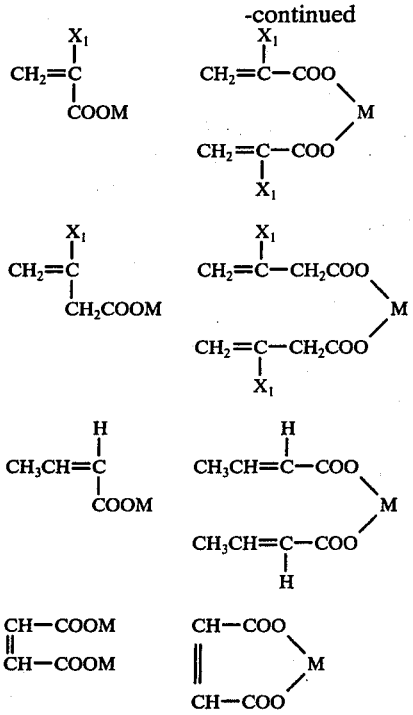

wherein $X_1$ is selected from H, $CH_3$ and COOM and M is selected from the class of an alkali metal and an alkaline earth metal, said monomers of formulae (1), (2), and (3) in a mole ratio sufficient to prevent a decrease in the solubility of the copolymer in the carrier liquid.

2. A liquid developer for developing an electrostatic latent image according to claim 1, in which the electrically insulating carrier liquid is an organic solvent having a volume resistivity of at least $10^9$ ohm-cm and a dielectric constant of 3 or less.

3. A liquid developer for developing an electrostatic latent image according to claim 1, in which the toner is a fine particle composed of a pigment and a resin.

4. A liquid developer for developing an electrostatic latent image according to claim 1, in which the copolymer is contained in an amount ranging from 0.015 g. to 10 g. in 1 liter of the electrically insulating carrier liquid.

5. A liquid developer for developing an electrostatic latent image according to claim 1, in which the copolymer is contained in an amount ranging from 0.015 g. to 1.0 g. in 1 liter of the electrically insulating carrier liquid.

6. A liquid developer for developing an electrostatic latent image according to claim 1, in which the monomer of the formula (1) is selected from the class of vinyl laurate, vinyl oleate, vinyl stearate, dodecyl acrylate, octyl acrylate, stearyl acrylate, tridecyl acrylate, hexadecyl acrylate, dodecyl methacrylate, heptadecyl methacrylate, stearyl methacrylate, lauryl vinyl ether, n-octyl vinyl ether and tridecyl vinyl ether.

7. A liquid developer for developing an electrostatic latent image according to claim 1, in which the monomer of the formula (2) is selected from the class of o-allylphenol, m-allylphenol, p-allylphenol, 4-allyl-2-methoxyphenol, 4-vinyl-2-methoxyphenol, o-vinylphenol, m-vinylphenol, p-vinylphenol, 2,5-dihydroxystyrene, 4-allyl-2,6-di-tert-butylphenol, 4-vinyl-2,6-di-tert-butylphenol, 4-allyl-2,6-dimethoxyphenol, 4-vinyl-2,6-dimethoxyphenol, 2-vinyl quinoline, 4-vinyl quinoline, 2-allyl quinoline, 4-allyl quinoline, N-vinyldiphenylamine, N-vinylmethyl-β-naphthylamine, N-vinylphenyl-α-naphthylamine, N-vinyl-p-tolyl-α-naphthylamine, N-vinyl-o-tolyl-α-naphthylamine and N-vinyl-m-tolyl-α-naphthylamine.

8. A liquid developer for developing an electrostatic latent image according to claim 1, in which the monomer of the formula (3) is selected from the class of sodium acrylate, potassium acrylate, lithium acrylate, sodium methacrylate, potassium methacrylate, lithium methacrylate, sodium itaconate, potassium itaconate, lithium itaconate, sodium crotonate, potassium crotonate, lithium crotonate, sodium maleate, potassium maleate, lithium maleate, calcium acrylate, barium acrylate, calcium methacrylate, barium methacrylate, calcium itaconate, barium itaconate, calcium crotonate, barium crotonate, calcium maleate and barium maleate.

* * * * *

UNITED STATES PATENT OFFICE

CERTIFICATE OF CORRECTION

Patent No. 4,040,970 Dated August 9, 1977

Inventor(s) Terukuni Tsuneda

It is certified that error appears in the above-identified patent and that said Letters Patent are hereby corrected as shown below:

Column 2, line 9, "in" should be --is--;

Column 2, line 13, "is" should be --it--;

Column 5, line 66, "Seikafast Blue" should be --Seikalight Blue--;

Column 6, line 5, insert --Mogul A, Elftex 5, Elf Vulcan XC, Statex, Carbon Black XC-550, Carbon Black No.44 and Carbon Black No.00 are all carbon black and their color index numbers are C.I. 77266--.

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*